United States Patent [19]

Kijima et al.

[11] Patent Number: 4,541,566

[45] Date of Patent: Sep. 17, 1985

[54] ATOMIZING DISC FOR A CENTRIFUGAL ATOMIZER

[75] Inventors: Shoichiro Kijima, Kamakura; Masaaki Ohkawara, Yokohama, both of Japan

[73] Assignee: Ohkawara Kakohki Kabushiki Kaisha, Kanagawa, Japan

[21] Appl. No.: 657,520

[22] Filed: Oct. 4, 1984

Related U.S. Application Data

[63] Continuation-in-part of Ser. No. 386,450, Jun. 9, 1982, abandoned.

[30] Foreign Application Priority Data

Jul. 14, 1981 [JP] Japan ..... 56-103395

[51] Int. Cl.[4] ..... B05B 3/10

[52] U.S. Cl. ..... 239/224; 239/381

[58] Field of Search ..... 239/380, 381, 214, 223, 239/224, 225, 231

[56] References Cited

U.S. PATENT DOCUMENTS

| | | | |
|---|---|---|---|
| 1,753,019 | 4/1930 | Page | 239/224 |
| 2,220,275 | 11/1940 | Preston | 239/223 |
| 3,080,122 | 3/1963 | Cordua | 239/224 |
| 3,711,025 | 1/1973 | Miller | 239/380 |

FOREIGN PATENT DOCUMENTS 48-21103 6/1973 Japan .

*Primary Examiner*—Andres Kashnikow
*Assistant Examiner*—Scott D. Malpede
*Attorney, Agent, or Firm*—Stevens, Davis, Miller & Mosher

[57] ABSTRACT

This is relates to an atomizing disc for a centrifugal atomizer wherein a plurality of atomizing conical pins are mounted along the peripheral edges of upper and lower mounting discs, and raw liquid supplied by rotation of the atomizing disc are atomized in an outer peripheral direction.

4 Claims, 12 Drawing Figures

NO. 1 Straight Pin ($\alpha = 90°$)

NO. 2 Taper Pin ($\alpha = 70°$)

NO. 3 Taper Pin ($\alpha = 50°$)

NO. 4 Curved Taper Pin ($\alpha = 30°$)

NO. 5 Curved Taper Pin ($\alpha = 65°$)

Oumulative Undersize Distribution in Weight Basis

| NO. | Symbol | α | 50% Dia (μm) | θ |
|---|---|---|---|---|
| 1 | ---● | 90 | 72 | 63.7 |
| 2 | -·-△ | 70 | 68 | 63.1 |
| 3 | --□ | 50 | 73 | 71.3 |
| 4 | —○ | 30 | 74 | 73.4 |
| 5 | —× | 65 | 64 | 65.7 |

ATOMIZING DISC FOR A CENTRIFUGAL ATOMIZER

This is continuation in part of the application Ser. No. 386,450, filed June 9, 1982, now abandoned.

BACKGROUND OF THE INVENTION

Atomizing discs have been proposed in Japanese Utility Model Publication No. Showa 48-21103 in which atomizing pins are detachably mounted between upper and lower mounting discs. In this well-known art, however, the atomizing pins are cylindrical in shape, which poses the following problems. That is, as shown in FIG. 6 raw liquid supplied directly from a raw liquid feed pipe or supplied through a liquid distributor flows along the lower mounting disc and reaches the peripheral surfaces of the pins and is attached thereto. However, since the pins are perpendicular to the lower mounting disc, the liquid does not move up very far due to the weight of the raw liquid, thereby forming a thick portion towards the lower portion of the cylindrical peripheral surface and a thin portion towards the upper peripheral surface. Even if the atomizing disc is rotated under this condition, a difference in thickness of raw liquid attached to upper and lower peripheral surfaces remains unchanged because the centrifugal forces of upper and lower peripheral surfaces of the cylindrical pins are the same. As a consequence, a large amount of raw liquid in the form of a thick film is atomized from the lower peripheral surface of the pin whereas a small amount of raw liquid in the form of a thin film is atomized from the upper peripheral surface thereof, thereby bringing forth an unevenness of particle size. The atomizer of the known type fails to provide an even particle size of atomized liquid and achieve a complete pulverization of the raw liquid. It is therefore an object of the present invention to solve these problems noted above with respect to the well-known art.

That is, in accordance with the present invention, the atomizing pin for the atomizing disc is formed into a conical configuration to thereby materially increase the evenness of the particle size of the atomizing liquid as compared with the known art.

The present invention has advantages as follows:

(a) Since the atomozing member is conical in shape, the raw liquid attached to the lower peripheral surface thereof thick at the initial stage of operation gradually crawls up towards the upper peripheral surface due to a difference in centrifugal force resulting from a difference between diameters of circles with upper and lower peripheral surfaces about an axis of the atomizing disc, to make the thickness of the liquid attached thereto uniform. Thus, the distribution of particle size of the atomizing liquid also becomes uniform.

(b) The force by which raw liquid is scattered varies due to the difference in the centrifugal forces resulting from the difference between the diameters of circles with the upper and lower peripheral surfaces of the conical member about the center axis of the atomizing disc. Thus even if the liquid attached to the lower peripheral surface of the conical member is thicker, the distribution of particle size of the atomizing liquid is made uniform.

(c) In the case the atomizing conical member revolves, the distribution of the particle size of the atomizing liquid is made more uniform due to the difference of centrifugal force because of the difference between the diameters of upper and lower peripheral surfaces of the conical member.

BRIEF SUMMARY OF THE INVENTION

The present invention provides an atomizing disc for a centrifugal atomizer of the type in which a plurality of atomizing pins are fixedly or rotatably mounted along the peripheral edges of upper and lower mounting discs, and a raw liquid supplied from a raw liquid feed pipe by rotation of the atomizing disc is atomized in an outer peripheral direction after a liquid film thereof has been made uniform on the peripheral surfaces of the pins. The atomizing pins are formed into a conical configuration having an angle formed between a conical surface and a bottom surface of the atomizing pin of below 60°. The atomizer is operated under conditions of 13–320 m/sec peripheral velocity of the disc, 1.0–4.0 of specific gravity of the raw liquid and 5–18,000 c.p. of viscosity of the raw liquid.

The present invention provides uniform pulverization of droplets by the employment of the structure as described hereinbefore.

BRIEF DESCRIPTION OF THE SEVERAL VIEWS OF THE DRAWINGS

The present invention will be made more clearly by reference to the accompanying drawings in which.

DETAILED DESCRIPTION OF THE PREFERRED EMBODIMENTS

Figure 1:
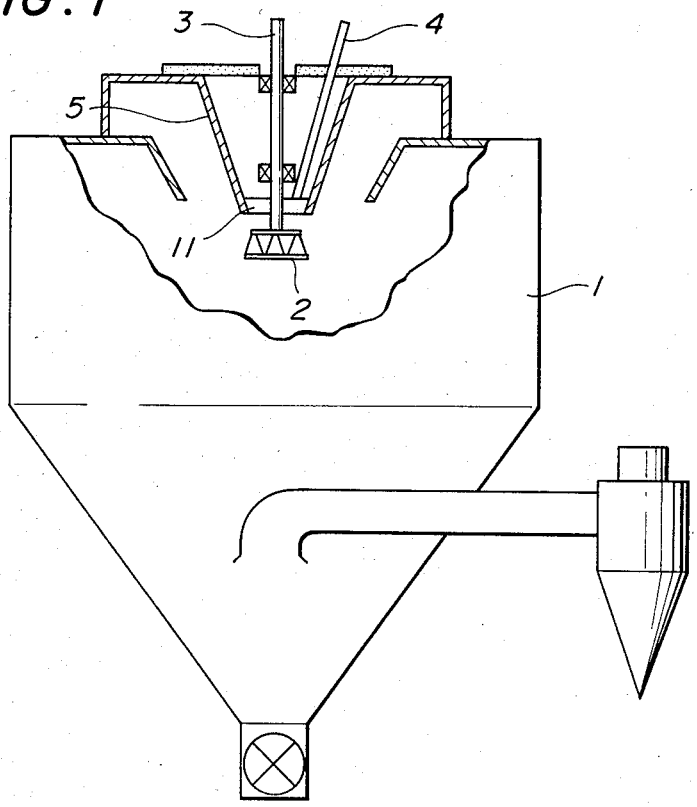
FIG. 1 is a cross sectional view of a spray dryer which uses an atomozing disc in accordance with the present invention.

By referring to the drawings there is shown a drying chamber 1, an atomizing disc 2, a rotary shaft 3 for the atomizing disc for securing a lower mounting disc 6 of the atomizing disc 2, a raw liquid feed pipe 4, a support frame 5 for the rotary shaft 3 and a lower mounting disc 6 for the atomizing disc 2, having a projection 6*a* about the rotary shaft 3 mounted in the central portion and a lower portion 6*b* in the peripheral surface thereof. Numeral 7 designates an upper mounting disc and 8, a conical or frusto-conical atomizing conical member, which is fixed to or rotatably mounted on a shaft 9. The shaft 9 is provided to fix the upper and lower mounting discs 6 and 7 integral with each other. The atomizing conical member 8 is mounted in contact with or sunken in the lower portion in the peripheral surface of the lower mounting disc 6.

Prior to describing the operation of the embodiment, the therory will be discussed. That is, more uniform fine particles are obtained by more thickness of a liquid film and by the uniform atomizing force. The average particle size of fine particles varies with the thickness of the liquid film and the atomizing force. This atomizing force comprises pressure of liquid in case of a pressure nozzle, pressure and amount of gases in case of a two-part fluid nozzle, and an impingement force between liquid scattered by the centrifugal force and gas in case of the centrifugal atomizer in the present invention.

Figure 6:
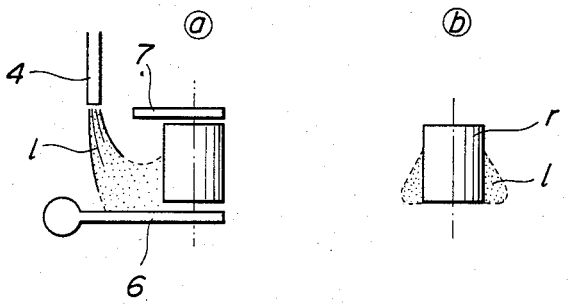
FIG. 6 is a view for explanation of a conventional atomizing pin.

In well-known technology as shown in FIG. 6, since the atomizing pin (r) is cylindrical in shape, raw liquid (l) supplied from the raw liquid feed pipe 4 flows downwardly by gravity, along the cylindrical surface of the atomizing pin (r) as shown in FIG. 6 (*b*), upon rotation of the atomizing disc 6. This is because of the fact that since the pin (r) is cylindrical in shape, the centrifugal force generated by rotation of the atomizing disc 6 is such that the centrifugal force in the upper portion of the pin is equal to that of the lower portion thereof. For this reason, when the raw liquid (l) is atomized, the particle size of the atomizing liquid will not be uniform.

In view of the aforementioned phenomen, it has been found that the uniformness of particle size of the atomizing liquid may be enchanced by forming the atomizing pin (r) into a conical configuration.

The operation of the present invention will be described now with reference to the embodiment shown in the drawings.

Figure 3:
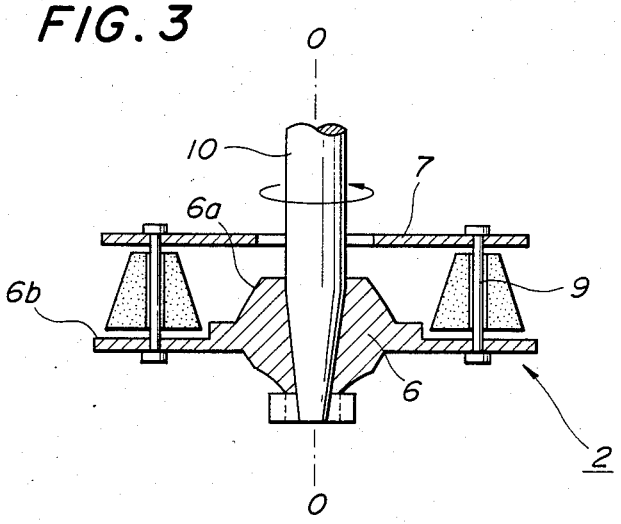
FIG. 3 is a sectional view of a principal portion of the atomizing disc of the present invention.
Figure 4:
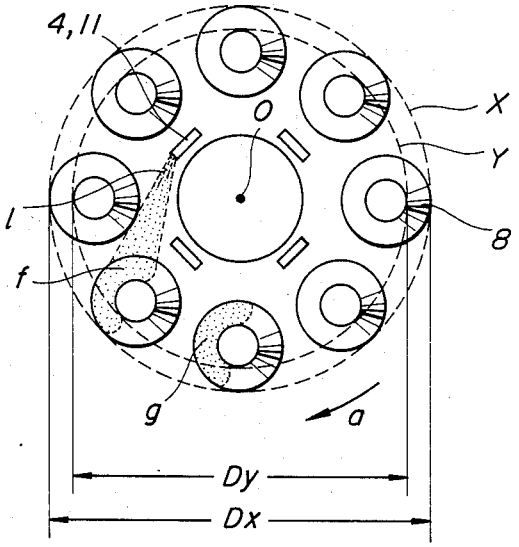
FIG. 4 is a plan view of the lower mounting disc.
Figure 5:
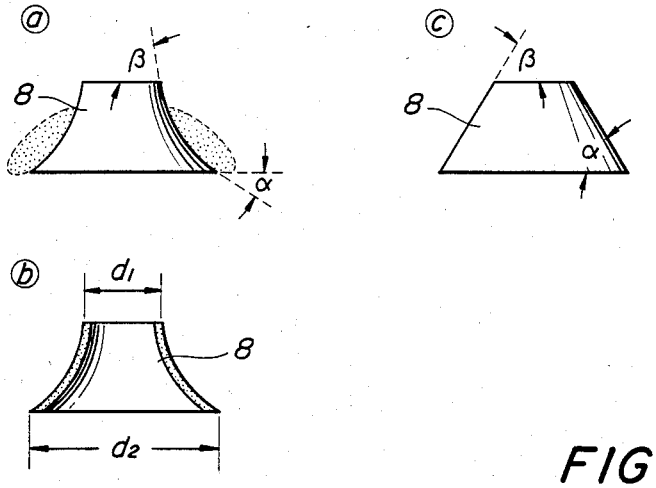
FIG. 5 (*a*),(*b*) and (*c*) are views for explanation of the operation of an atomizing conical member.

Referring to FIGS. 3 and 4, the raw liquid (l) supplied onto the surface of the lower mounting disc 6 directly from the raw liquid feed pipe 4 or through the liquid distributor flows down the central projection 6*a* as the lower mounting disc rotates reaching the atomizing conical member 8, attached to the lower peripheral surface thereof, where it starts to move upwardly. At this time, the smaller the ascending angle of raw is towards each other, that is, the closer the angle $\alpha$ formed between the conical surface and bottom of the conical member 8 in FIG. 5 is to 0 degree, the large the amount of raw liquid will move upwardly uniformly onto the surface of the atomizing conical member with less resistance and turbulence. This angle $\alpha$ should be below 60 degrees, particularly 20 to 40 degrees, as shown in FIG. 5 and it is desireable to have a rotary member having a starting curve of 0 degree as in the secondary curve rising from the surface of the lower mounting disc 6.

In case the height of the disc is relatively low (that is, the height of the pin is relatively low), the angle $\alpha$ is preferably from 0 to 20 degrees. If the pin is made of a special material such as ceramics, (normally the pin is made of stainless steel), the angle $\alpha$ is selected to have an angle of 40 to 60 degrees in consideration of the strength of the pin.

It has been proven from experiments that if the angle $\alpha$ exceeds 60 degrees, the resistance increases so materially as to impede the upward movement of the liquid on the surface of the atomizing conical member, thus rapidly reducing the effect of pulverization of the raw liquid.

The raw liquid starts moving upwardly from the lower portion of the atomizing conical member and continues to move upwardly due to the centrifugal force resulting from rotation of the lower mounting disc 6 and then the raw liquid moves away from the conical member in the vicinity (f in FIG. 4) of a point at right angle with respect to the lower mounting disc for spraying. It is to be noted here that the raw liquid is made thick in the peripheral surface of the conical member and thin in the upper peripheral surface thereof depending on the specific gravity, viscosity and the like of the raw liquid. Assume now in FIG. 4 that Dx represents the diameter of a circle X with the lower peripheral surface of the conical member 8 about a center axis of the atomizing disc 2, and Dy represents the diameter of a circle Y with the upper peripheral surface of the conical member 8 about the center axis 0 of the atomizing disc 2.

There occurs a difference in the centrifugal force and peripheral velocity due to the difference in the aforesaid diameters Dx and Dr, as the atomizing disc 2 rotates, at f (f in FIG. 4) in the neighborhood of the point where the raw liquid is atomized. Due to the difference in the centrifugal force and peripheral velocity between the upper and lower peripheral surfaces, the liquid film at the lower peripheral surface is made thick and a large amount of raw liquid is pulverized by greater force into uniform fine particles whereas the liquid film at the upper peripheral surface is made thinner and a small amount of raw liquid is pulverized by a smaller force into uniform fine particles.

The degree of the difference between and change in diameters Dx and Dy is optimally selected depending on the specific gravity, viscosity or the like of the raw liquid l, and on whether the conical member 8 is fixed or rotatable, but the angle $\alpha$ formed between the upper portion of the conical member 8 and the bottom surface of the upper mounting disc is selected to have an angle of 45 to 60 degrees.

Further, the following conditious are necessary for the atomizing disc according to the presnt invention to result in complete evenness of the particle size of the atomizing liquid. Namely, peripheral velocity of the disc is in the range of 13 to 320 m/sec, preferably 22 to 270 m/sec and more preferably 35 to 160 m/sec.

Specifie gravity of the raw liquid (l) is in the range of 1.0 to 4.0, preferably 1.0 to 2.5 and more preferably 1.1 to 2.0. And viscosity of the raw liquid (l) is in the range of 5 to 18,000 cp, preferably 15 to 10,000 cp and more preferably 60 to 5,000 cp.

Figure 2:
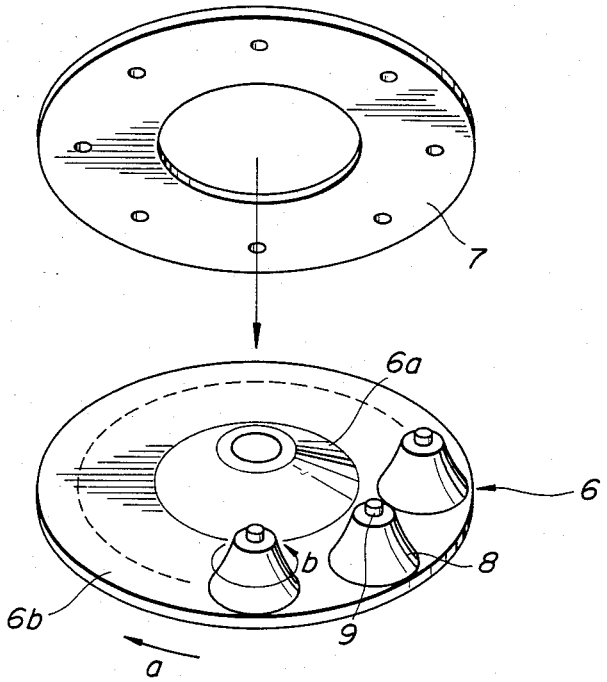
FIG. 2 is a perspective view of of a lower mounting disc with an upper mounting disc removed.
Figure 7:
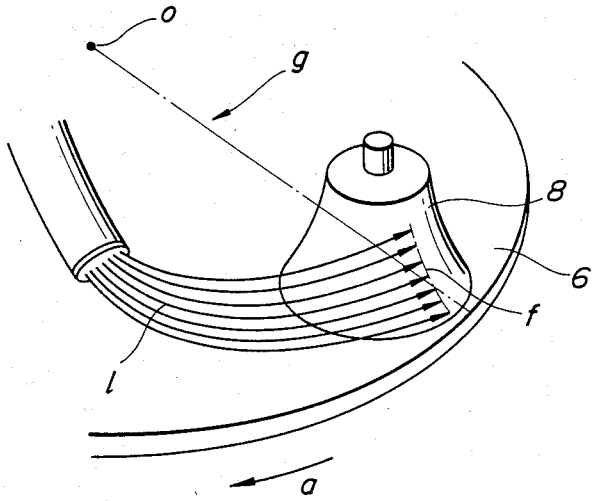
FIG. 7 is a skelton type explanatory view for explanation of the operation of the present invention.

Next, where the atomizing conical member 8 is rotatably mounted on the atomizing disc 2, and the disc 2 rotates at a high speed in the direction as indicated by the arrow a as shown in FIG. 4, the raw liquid accumulates in larger amount to the portion on the left side (as viewed in FIG. 4) rather than the portion on the right side of a line (FIGS. 4 and 7) formed between the center axis 0 and the center of the conical member 8, and the conical member 8 revolves in the direction as indicated by the arrow b (FIG. 2) owing to the difference in amount of raw liquids subjected to the centrifugal force, the viscosity of the raw liquid l or the like.

At this time, there occurs a difference in upper and lower peripheral speeds of the conical member 8 due to the difference in upper and lower diameters d1 and d2 of the conical member 8 shown in FIG. 5, that is, due to the difference in upper and lower peripheral lengths. Because of the difference in peripheral speeds, the raw liquid attaches in larger amount to the lower portion rather than the upper portion of the conical member 8, that is, at f (f in FIG. 4) in the neighbourhood of the point where the liquid is atomized difference in thickness of raw liquid l between the upper and lower surfaces of the conical member 8 is decreased to achieve a uniform pulverization.

The water atomizing experiments by the rotary secondary conical member constructed in accordance with the present invention have brought forth a definite difference between the atomizer of the present invention and the prior art cylindrical or multi-blade type in terms of improvements in distribution of particle size in the the case the number of revolutions and diameter of the atomizing disc are the same therebetween.

In addition, in the atomization of raw liquids having high wearing properties, it becomes possible to considerably extend the service life of the conical member 8 by the liquid flow with less resistance as previously described in connection with the operation of the present invention, or by the use of a wear-resisting conical member 8 as the case may be.

If the disc provided with a conical pin is used for atomization of corrosive slurry, the pin part is formed of a corrosion resisting material such as super-hard alloy, ceramic, etc. The service life of the disc is greatly prolonged by treating the surface thereof with wearresisting material.

EXAMPLE

The invention is further described hereinbelow by way of the Example thereof.

Figure 8:
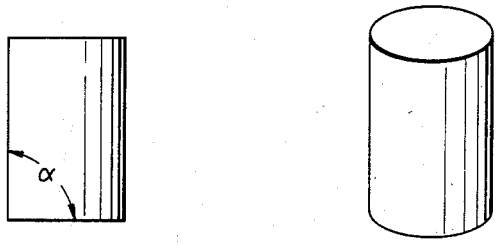
FIG. 8 shows each shape of a conventional straight cylindrical pin and four kinds of taper pins.
Figure 8:
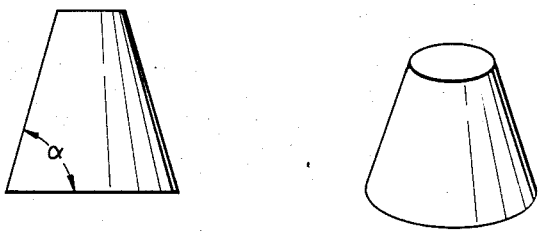
Figure 8:
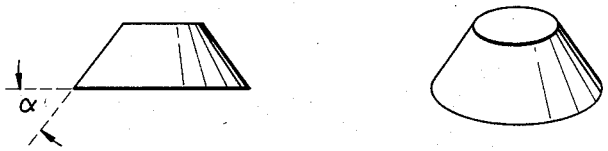
Figure 8:
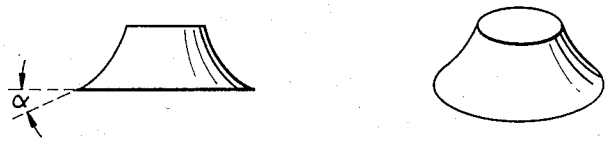
Figure 8:
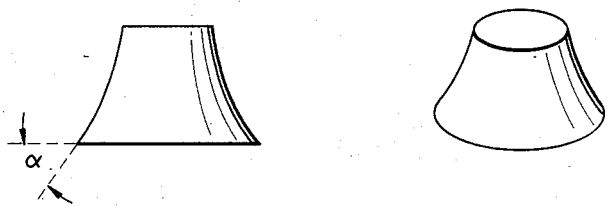

The test was conducted by using four kinds of taper pins and a conventional straight pin. The shape of three pins is shown in FIG. 8. Slurry or solution of materials shown in No. 1–No. 24 of Table 1 were used as a raw liquid.

The dimension of the spray dryer with rotary atomizer, which were used for the test, are shown in Table 2.

Figure 9:
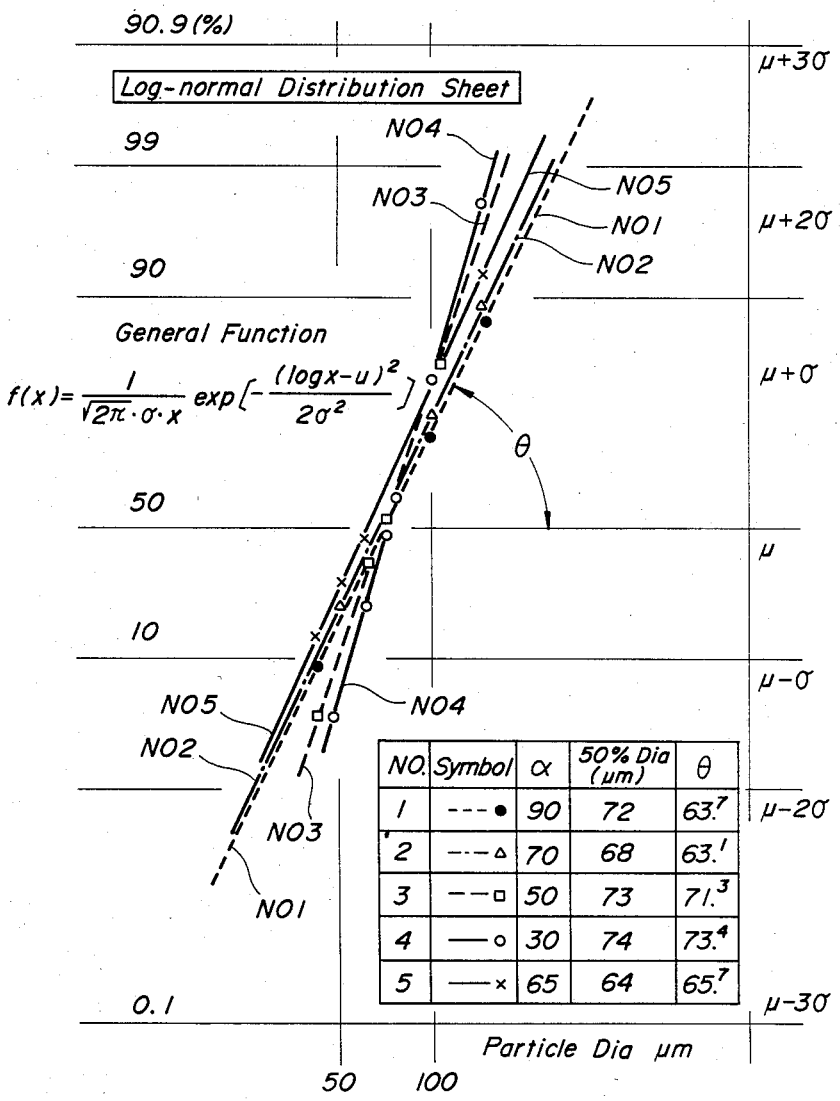
FIG. 9 shows the cumulative undersize distribution in weight basis as to one test (No. 1) in Example.

The test was conducted each for 1–2 hours under the conditions that the hot gas inlet temperature is in the range of 70° to 250° C. and exhaust gas temperature of 45° to 110° C., and a typical portion is subjected to sampling to provide a product for testing. The product obtained is sized by the taping shifter, and the cumulative undersize distribution in weight basis is plotted on log-normal-distribution paper, one test (No. 1) of which is shown in FIG. 9. In the same manner as the test No. 1, in regard to slurry or solution of materials of No. 1–No. 24 shown in Table 1, the comparison of angle $\theta$ in the vicinity of 50% Dia. of a straight line which connects the plotted points is as shown in Table 1 and FIG. 10.

The greater the angle $\theta$, the particle distribution is narrow (or sharp).

Figure 10:
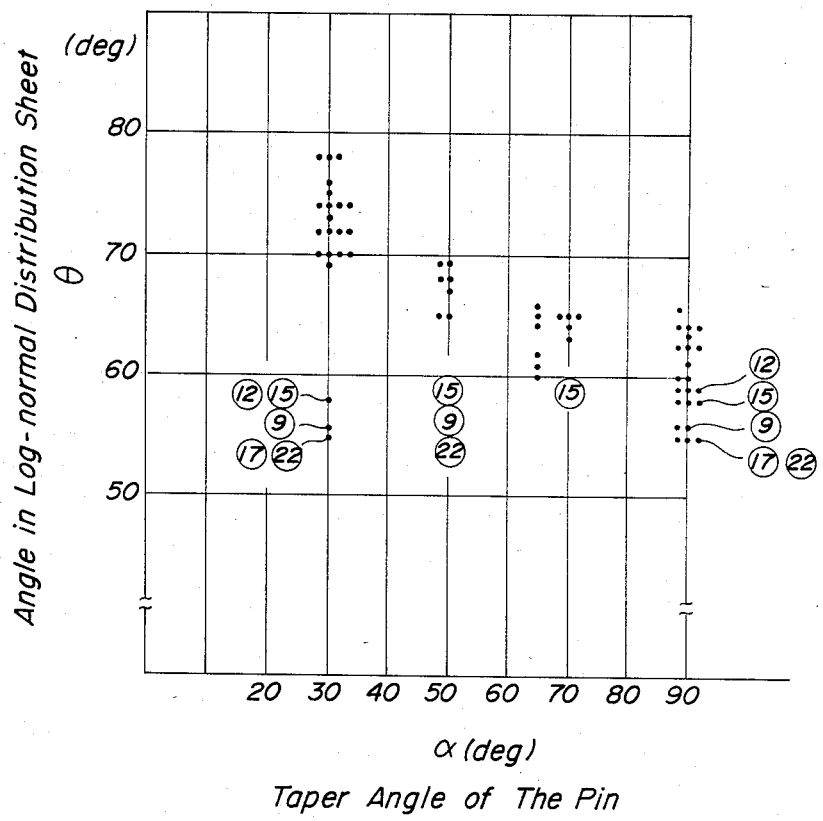
FIG. 10 shows comparison of angle $\theta$ in the vicinity of 50% Dia. of a straight line connects the plotted points of the test No. 1–No. 24 in Example.

As can be seen from Table 1 and FIG. 10, there obviously occurs a great difference in particle size distribution between the case under the specific conditions.

That is, if atomization is effected by the disc specified in this invention and under the operating conditions selected by this invention, the product having the narrow (or sharp) particle size distribution is produced by the spray dryer.

TABLE 1

| No. | Material | S.G. | Vis. (c.p.) | Sp | $\theta$ of pin 1 | 2 | 3 | 4 | 5 | Table 2 | G/B |
|---|---|---|---|---|---|---|---|---|---|---|---|
| 1 | Ferrite ($Fe_2O_3$) | 1.7 | 80 | 53 | 63.7 | 63.1 | 71.3 | 73.4 | 65.7 | 1 | G |
| 2 | Aluminum hydrate: $Al(OH)_n$ | 1.2 | 5,000 | 88 | 62 | — | — | 74 | — | 2 | G |
| 3 | Maltose | 1.3 | 17,000 | 255 | 56 | — | — | 70 | 65 | 4 | G |
| 4 | Alumina ($Al_2O_3$) | 1.7 | 700 | 62 | 66 | — | — | 78 | — | 2 | G |
| 5 | Alumina ($Al_2O_3$) | 1.2 | 17 | 65 | 63 | — | — | 72 | 64 | 1 | G |
| 6 | Alumina ($Al_2O_3$) | 1.8 | 200 | 35 | 63 | — | 69 | 70 | — | 1 | G |
| 7 | Calcium: ($C_2(OH)_2$ hydroxide | 1.2 | 100 | 251 | 60 | 59 | 65 | 74 | — | 4 | G |
| 8 | Amino acid | 1.1 | 10 | 157 | 60 | — | — | 74 | — | 3 | G |
| 9 | Pigment | 1.1 | 20,000 | 70 | 56 | — | 55 | 56 | — | 2 | B |
| 10 | Melamin resin | 1.2 | 50 | 88 | 58 | — | 69 | 70 | — | 2 | G |
| 11 | Melamin resin | 1.3 | 25 | 66 | 59 | — | — | 72 | 62 | 1 | G |
| 12 | Silicon nitride: SiN | 1.5 | 2,500 | 10 | 59 | — | — | 58 | — | 1 | B |
| 13 | Malto-triose | 1.2 | 100 | 164 | 56 | — | 67 | 74 | 60 | 3 | G |
| 14 | Silicon carbide: SiC | 1.2 | 3,800 | 44 | 64 | 65 | 74 | 76 | — | 1 | G |
| 15 | Glucose | 1.1 | 0.9 | 94 | 58 | 59 | 59 | 58 | — | 2 | B |
| 16 | Tungsten carbide alloy | 4.0 | 6,000 | 22 | 64 | 64 | — | 78 | — | 1 | G |
| 17 | Tungsten carbide alloy | 4.4 | 3,000 | 44 | 55 | — | — | 55 | — | 1 | B |
| 18 | Zirconia | 1.3 | 1,200 | 88 | 63 | — | — | 75 | — | 1 | G |
| 19 | Alumina ($Al_2O_3$) | 1.8 | 60 | 45 | — | 65 | — | 72 | — | 1 | G |
| 20 | Ferrite ($Fe_2O_3$) | 1.8 | 5,000 | 35 | 59 | — | — | 72 | — | 1 | G |
| 21 | Regulated milk | 1.1 | 40 | 66 | 55 | — | 68 | 69 | — | 2 | G |
| 22 | Lecitin | 0.9 | 30 | 105 | 55 | — | 54 | 55 | — | 2 | B |
| 23 | Silicon Nitride: SiN | 2.0 | 1,500 | 35 | 64 | 65 | 72 | 78 | — | 1 | G |

TABLE 1-continued

| No. | Material | S.G. | Vis. (c.p.) | Sp | θ of pin 1 | 2 | 3 | 4 | 5 | Table 2 | G/B |
|---|---|---|---|---|---|---|---|---|---|---|---|
| 24 | Engyme | 1.0 | 150 | 94 | 58 | 58 | — | 70 | 61 | 2 | G |

S.G.: Specific gravity
Vis.: Viscosity
Sp: Peripheriral velocity of the disc: m/sec
θ of pin: Angle θ in Log-normal-Distribution Sheet of No. 1-No. 5 pins shown in FIG. 8.
1,2,3,4,5 shows pin No. of FIG 8.
Table 2: No. of spray dryer in Table 2 used in test
G/B: Valuation of result, G: good B: bad

TABLE 2

| Dimensions of spray dryer with rotary atomizer | Dryer No. | | | |
|---|---|---|---|---|
| | No. 1 | No. 2 | No. 3 | No. 4 |
| Dryer Dia. (mm) | 1600 | 2250 | 7800 | 10000 |
| Total Height (mm) | 2500 | 500 | 12000 | 22000 |
| Disc Dia. (mm) | 64 | 125 | 320 | 440 |
| No. of pin | 12 | 24 | 32 | 48 |
| Bottom Dia. of taper pin (mm) | 9 | 9 | 24 | 24 |
| Bottom Dia. of straight pin (mm) | 7 | 7 | 18 | 18 |
| Feed rate of raw liquid (kg/hr) | 10-50 | 20-300 | 20-2000 | 3000-12000 |

What is claimed is:

1. An atomizing disc for a centrifugal atomizer of the type in which a plurality of atomizing pins are fixedly or rotatably mounted along the peripheral edges of upper and lower mounting discs, and a raw liquid supplied from a raw liquid feed pipe by rotation of the atomizing disc is atomized in an outer peripheral direction after a liquid film thereof has been made uniform on the peripheral surfaces of pins, characterized in that said atomizing pins are formed into a conical configuration, an angle formed between a conical surface and a bottom surface of the atomizing pin is made below 60° and the atomizer are operated under conditions of 13-320 m/sec peripheral velocity of the disc, 1.0-4.0 of specific gravity of the raw liquid and 5-18,000 c.p. of viscosity of the raw liquid.

2. The atomizing disc according to claim 1, wherein said angle formed between a conical surface and a bottom surface of the atmizing pin is made from 20°-40°.

3. The atomizing disc according to claim 1, wherein the atomizer are operated under conditions of 35-160 m/sec of peripheral velocity of the disc, 1.1-2.0 of specific gravity of the raw liquid and 60-5,000 c.p. of viscosity of the raw liquid.

4. The atomizing disc according to claim 1, wherein an angle formed between the upper portion of the pin and the bottom surface of the upper mounting disc is in the range of 45 to 90 degrees.

* * * * *